US005236165A

United States Patent [19]

Conway

[11] Patent Number: 5,236,165

[45] Date of Patent: Aug. 17, 1993

[54] FASTENING SYSTEM FOR MOVABLE SEATING

[75] Inventor: Timothy M. Conway, Paw Paw, Mich.

[73] Assignee: Interkal, Inc., Kalamazoo, Mich.

[21] Appl. No.: 755,411

[22] Filed: Sep. 5, 1991

[51] Int. Cl.[5] ..... A47B 97/00

[52] U.S. Cl. ..... 248/503.1; 16/19; 248/500

[58] Field of Search ..... 248/500, 501, 503.1; 297/344, 385, 216, 336; 244/118.6, 118.5, 122 R; 296/65 R, 63; 16/19; 410/105, 115

[56] References Cited

U.S. PATENT DOCUMENTS

| | | | |
|---|---|---|---|
| 1,155,376 | 10/1915 | Sherer | 248/501 |
| 2,153,679 | 4/1939 | Rich | 248/501 X |
| 2,663,048 | 12/1953 | Ross | 280/43.14 X |
| 2,879,075 | 3/1959 | Wallace | 16/19 X |
| 3,533,585 | 10/1970 | Hollermann | 248/501 X |
| 4,380,296 | 4/1983 | Murray | 211/10 X |
| 4,602,756 | 7/1986 | Chatfield | 410/105 X |
| 4,856,738 | 8/1989 | Martin | 244/122 R |
| 4,936,527 | 6/1990 | Gorges | 244/118.6 |

FOREIGN PATENT DOCUMENTS

| | | | |
|---|---|---|---|
| 1515513 | 6/1978 | United Kingdom | 16/19 |

*Primary Examiner*—J. Franklin Foss
*Attorney, Agent, or Firm*—Baker & McKenzie

[57] ABSTRACT

This invention relates to a modular seating unit comprised of a plurality of chairs carried by a plurality of pedestals. The pedestals at each end of the seating unit have two casters which are movable into and out of operative position. The pedestal base may be attached to a floor by threaded bolts which are resiliently and retractably mounted to the base. Threaded bolts are supported by a coil spring which holds the bolt in an upward position to prevent damage to the threads at the end of the bolt. Threaded inserts built into the floor are color coded and are arranged in patterns which allow for placement of the seating units in various arrays. Plug-like devices are used to protect the threaded inserts and to keep debris out of the insert.

8 Claims, 2 Drawing Sheets

FASTENING SYSTEM FOR MOVABLE SEATING

BACKGROUND AND SUMMARY OF THE INVENTION

This invention relates to the field of movable seating and, in particular, to movable seating which may be moved into place and fixed to a floor.

Seating arrangements for large auditoriums and other meeting facilities are often required to be modular, so that different numbers and arrangements of seating can be provided. One way to provide movable and variable seating is to use groups of chairs having pedestals with retractable casters. Such units can be rolled into place quickly and the casters can then be retracted so that the units become relatively immobile. This kind of arrangement provides the user with the ability to quickly change an area from one which is an open space to one which has rows of seats, or to change from a seating arrangement which has seating at one orientation to one having a different orientation.

One of the difficulties associated with modular seating units having a plurality of seats mounted on pedestals having retractable casters is that such units can be moved even when the casters have been retracted. Shifting of the units by even small amounts can make the rows of seating misaligned, unsightly and unsafe. Furthermore, without predetermined locations for placement of the units, the spacing and arrangement of such seating will vary depending upon the judgement of the maintenance staff. This can result in variability of seating capacity and problems with the flow of spectator ingress and egress. Also, by firmly attaching the seating units to a supporting surface, the stability of the seating units can be greatly enhanced. This is particularly important in the event of panic, such as when a fire occurs.

Therefore, it is an object of the present invention to provide movable and relocatable modular seating units which can be quickly moved from one location to another.

Another object of the present invention is to provide modular seating units which can be quickly and easily attached to a supporting structure without the use of conventional tools.

Still another object of the present invention is to provide modular seating units having fasteners for attaching the units to a supporting structure which are carried by the seating unit itself.

Yet another object of the present invention is to provide modular seating units having floor fastening means which are retractably housed in the base of the seating unit.

A further object of the present invention is to provide a fastening system for modular seating in which the seating arrangements may be varied in predetermined plans or patterns.

Another object of the present invention is to provide a fastening system for modular seating in which the locations for placing the modular units in differing seating arrangements can be easily identified.

A further object of the present invention is to provide a fastening system for modular seating in which fasteners used to attach the seating to a support structure have the ability to compensate for variations in the alignment of the corresponding inserts to which the fasteners are attached.

These and other objects and advantages of the invention are achieved with a modular seating device comprising a plurality of chairs carried by a pair of bases or pedestals, each pedestal having a pair of retractable casters. The pedestals also have threaded bolts with turning knobs attached thereto, the threaded bolts being retractably mounted in the pedestal. Threaded inserts are disposed in a predetermined pattern in the flooring where the modular seating units are to be placed. When the threaded inserts are not being used to engage a threaded bolt of a seating unit, a painted plug-like device is placed in the threaded insert to protect the threads of the insert from damage and to prevent debris from collecting in the insert. Various seating arrangements are defined by the grouping of color coded inserts at particular locations.

The objects and advantages of the present invention will be better understood by a reading of the following specification in conjunction with the accompanying drawings.

DETAILED DESCRIPTION OF THE INVENTION

Figure 1:
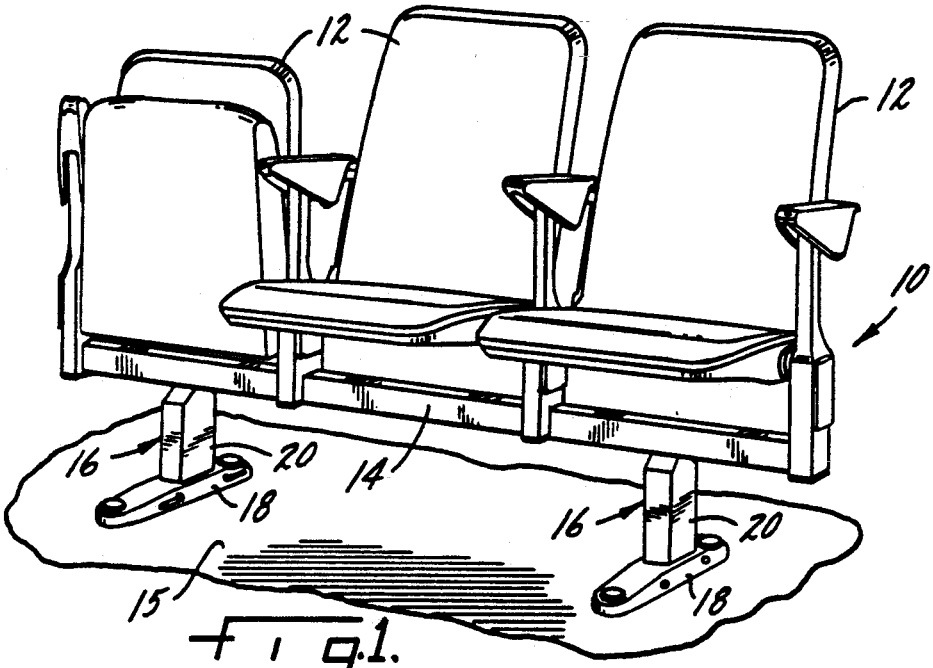
FIG. 1 is a perspective view a modular seating unit of the present invention.

FIG. 1 is a perspective view of a modular seating unit 10 having three chairs 12 supported on a cross member 14. The cross member 14 is supported by two pedestals 16.

Figure 2:
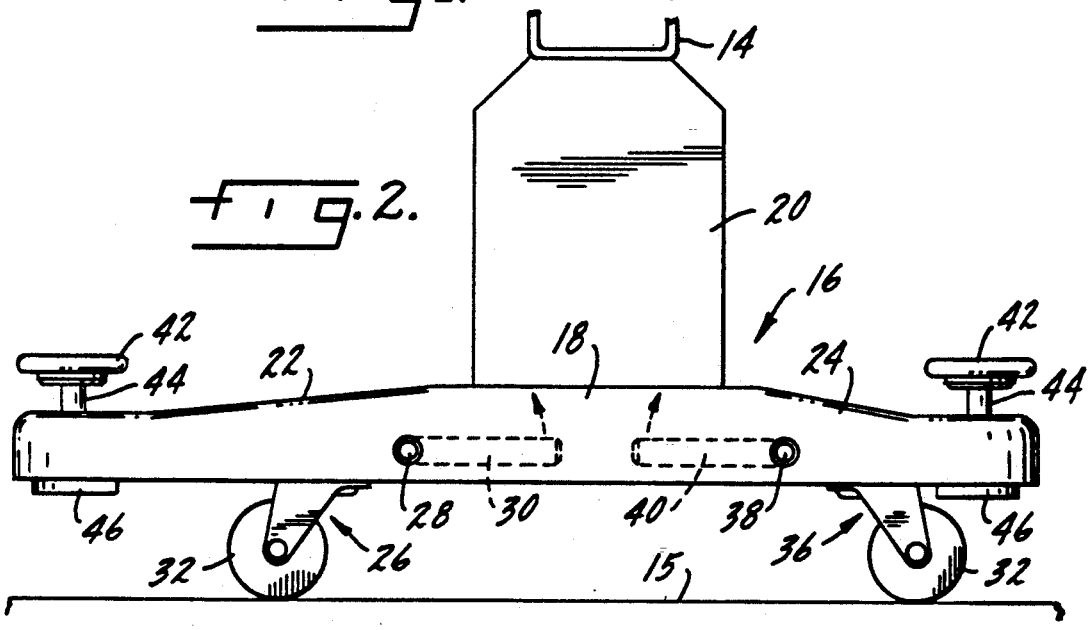
FIG. 2 is a partial side elevational view of a pedestal of the present invention with the casters in an operative mode.

FIG. 2 is an enlarged view of the pedestal shown on the left side of FIG. 1. Each pedestal 16 is comprised of a base 18 and a post 20. The base 18 has a front arm 22 and a back arm 24, the front arm being slightly longer than the back arm. The base 18 has a front caster 26 which pivots about a rod 28 when the handle 30 is rotated. Similarly, the back arm 24 carries a rear caster 36 which is brought into and out of its operative position by rotation about the pivot rod 38 upon rotation of the handle 40. Each caster has a wheel 32. When the casters 26 and 36 are rotated out of their operative positions (as shown in FIG. 2), the knobs 42 which are located at the distal ends of the arms 22 and 24, may be used to attach the base 18 to the floor 15. The knobs 42 are used to rotate the threaded bolts 44 into engagement with threaded inserts 54 (see FIGS. 4 and 5) located in the floor 15. The forces from the occupants of the chairs 12 are transferred from the modular unit 10 through the pads 46 to the floor 15, when the casters are in the inoperative position as shown in FIGS. 3 and 5.

Figure 3:
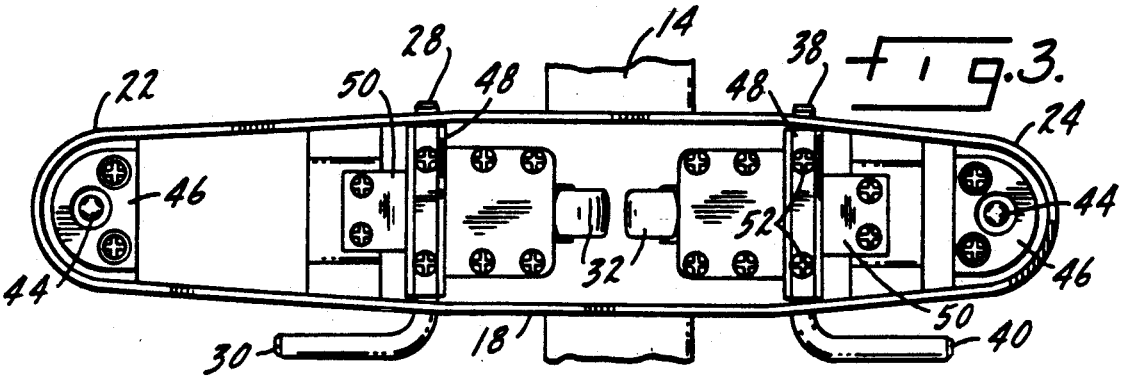
FIG. 3 is a bottom plan view of a base of the seating unit of the invention.

FIG. 3 shows the faceted sleeves 48 which surround the pivot rods 28 and 38. The faceted sleeves 48 cooperate with the flat spring plates 50 to hold the casters at predetermined positions of rotation about the pivot rods. When the casters are in the operative position as shown in FIG. 2, the handles 30 and 40 are pointed inward or toward each other. When the casters are in the inoperative or retracted position as shown in FIG. 3, the handles 30 and 40 are pointed outwardly or away from each other. In both the operative and inoperative positions, the flat spring plates 50 cooperate with the facets of the faceted sleeves 48 to retain the casters in their respective positions.

Figure 4:
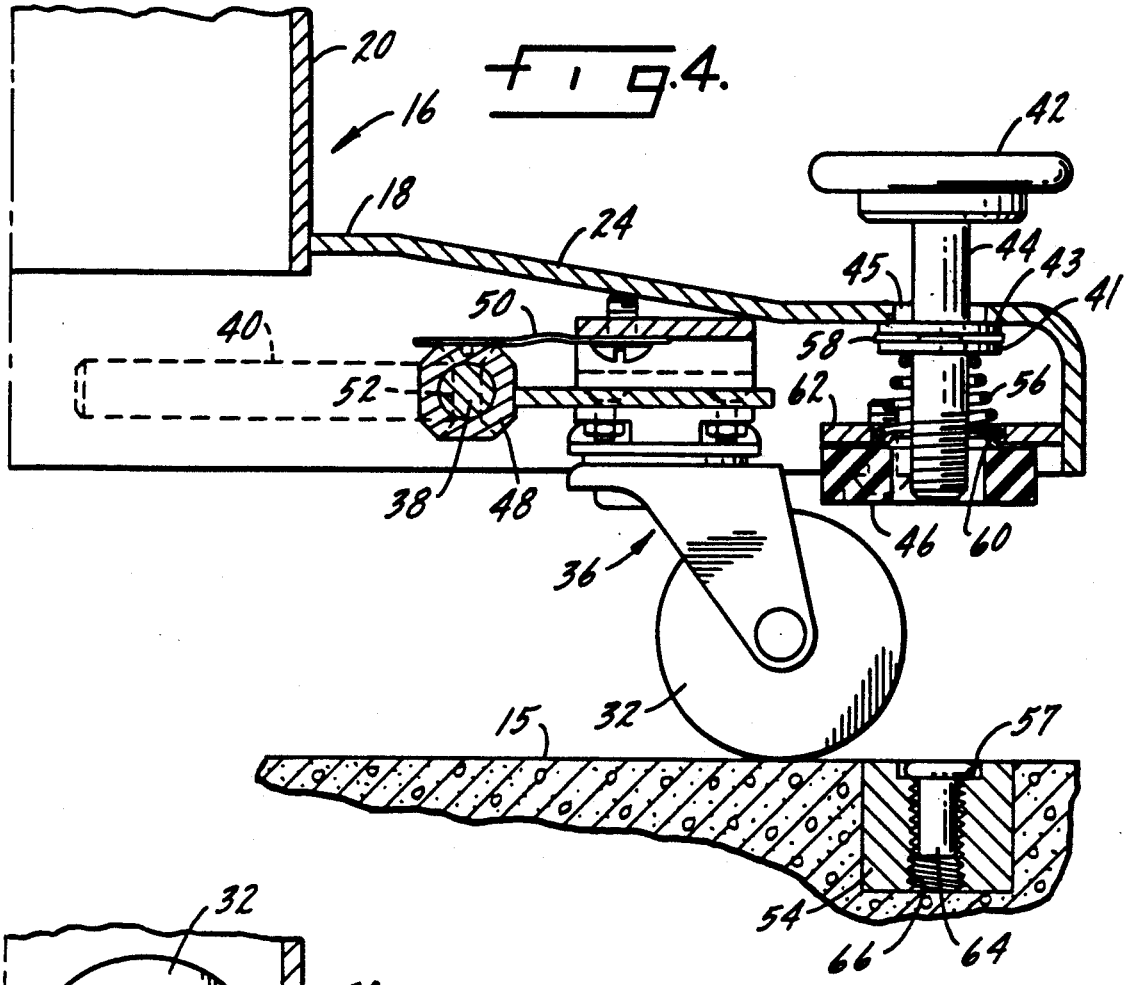
FIG. 4 is a sectional view showing the pedestal base of the present invention with the caster in an operative mode and the attachment means of the present invention in an inoperative mode.
Figure 5:
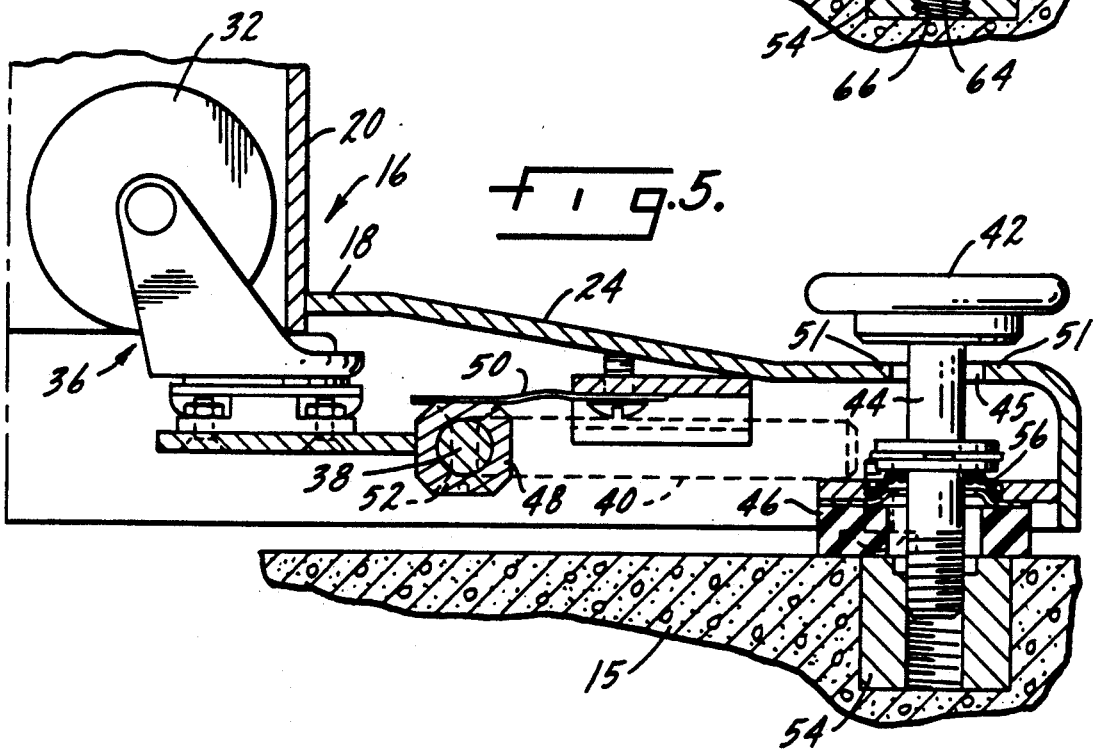
FIG. 5 is a sectional view of a pedestal base of the present invention with the caster in an inoperative mode and the fasting means in an operative mode.

FIGS. 4 and 5 show the caster 36 and the threaded bolt 44 in both the operative and inoperative positions. In particular, the caster 36 as shown in FIG. 4 has been rotated about the pivot rod 38 to a position where the wheel 32 is in contact with the floor 15. The flat spring plate 50 holds the faceted sleeve 48 against rotation, which in turn prevents downward rotational movement of the caster 36. Fasteners 52 are used to connect the faceted sleeve 48 to the pivot rod 38 so that rotation of the handle 40 causes rotation of the faceted sleeve 48. Rotation of the handle 40 in an upwardly arcing motion causes movement of the caster 36 from the position shown in FIG. 4 to the position shown in FIG. 5, wherein the wheel 32 of the caster 36 is housed within the post 20.

When the caster 36 has been rotated out of the operative position to the stored or inoperative position shown in FIG. 5, the knob 42 may be used to engage the threaded bolt with the threaded insert 54. The threaded bolt 44 is held in an upward position by a helical coil spring 56. The helical coil spring 56 pushes against the lower washer 41, which in turn pushes upwardly against an E-ring 58 carried by a groove in the threaded bolt 44. Above the E-ring 58 is another washer 43 which is larger in diameter than the opening 45 in the arm 24. The washers 41 and 43 protect the E-ring from bearing directly against the Spring 56 and the portions 51 which surround the opening 45. The lower end of the helical coil spring 56 is supported by a dished retaining plate 60 disposed between the pad 46 and a support plate 62 which is mounted to the back arm 24. The underside of the knob 42, as shown in FIG. 5, bears against the portions 51 of the arm 24 which surrounds the opening 45. It is the clamping interaction between the underside of the knob 42 and the portions 51 which hold the pedestal, and thus the seats, in place.

A plug-like device or rivet 64 is placed in the threaded insert 54 to prevent damage to the female threads 66 when the insert 54 is not being used to hold a seating unit in place. The rivet 64 has a head which has a height equal to the depth of the recess 57 in the insert 54. Thus, when the rivet 64 is inserted into the insert 54, the top of the head of the rivet 64 is flush with the floor to provide a continuation thereof. The sides of the rivet head are rounded to prevent removal of the rivet by hand. If a ferrous material is used for the rivet 64, a magnet can be used to easily extract the rivet from the insert 54 when the insert 54 is ready to be used.

After removing the rivet 64 from the insert 54, the threaded bolt 44 should be aligned with the threads 66 of the insert 54. The threaded bolt 44 can then be pushed downward into engagement with the insert 54, and the knob 42 can be rotated by hand to cause the threaded engagement as shown in FIG. 5.

By using the threaded bolt 44 of the present invention, the seating unit 10 is firmly attached at a predetermined location on the floor 15. Inadvertent movement or misalignment of the seating unit 10 is thereby prevented. The spring loaded mounting of the bolt 44 prevents damage to the threads of the bolt 44 which could otherwise easily occur once the caster 36 has been rotated to the stored position.

The mounting arrangement of the bolt 44 is such that the fastening system of the present invention can compensate for variations in the alignment of the inserts. The openings in the pad 46, the support plate 62, the retaining plate 60, and the housing of the back 24, through which the bolt extends, are all about 60% larger than the diameter of the bolt. Thus, the bolt 44 is free to move laterally while remaining perpendicular to the floor. This lateral freedom of movement means that the bolts can compensate for significant variations in the spacing of the inserts into which the bolts must be threaded. The E-ring 58 limits the upward travel of the bolt by interfering with the housing of the arm 24, and provides a lifting surface against which the spring 56 can bear.

By using inserts of different colors or by painting the inserts different colors, the arrangement of the seating units can be simplified. For example, it may be desirable to have the seating units arranged facing in one direction for an event, and it may be necessary for the seating units to be arranged such that they face a different direction (e.g. 90° from the first direction) for an event later in the day. The threaded inserts can be arranged and placed in the flooring to accommodate these two differing seating arrangements. The inserts of the present invention can be painted or otherwise colored to easily identify the proper set of inserts to be used for a particular arrangement. Thus, an installer can use a magnet to extract all of the rivets from inserts of a particular color, thereby making ready an array of inserts which are to be used with a particular seating arrangement.

While a specific embodiment of the invention has been shown and described, it will be apparent to those skilled in the art that numerous alternatives, modifications, and variations of the embodiment shown can be made without departing from the spirit and scope of the appended claims.

I claim:

1. A fastening system for movable seating comprising a seat base supporting at least one seat, said seat base having movable caster means for bringing a plurality of casters into and out of operating and storage positions, and locking means for holding said seat base and said seat in a fixed position when said casters are not in said operating position, said locking means comprising male fastener means extending downwardly from said seat base, female fastener means carried by a support surface, said male and female fastener means mateable to form a connection between said seat base and said support structure, said male fastener means being resiliently and retractable mounted to said seat base such that said male fastener means is normally held in an up position where it does not interfere with said support surface, and such that said male fastening means may only be brought onto engagement with said female fastener by applying downward pressure on said male fastener means, said male fastener being a bolt-like member having threads at one end, an enlarged turning knob at the other end, and a flange carried out by said bolt-like member between said threads and said turning knob, a spring carried by a plate, said spring acting in compression between said flange and said plate to push said flange in an upward direction to provide said male fastener means adjustability and retractability with respect to said seat base.

2. A fastening system for movable seating in accordance with claim 1 wherein:

said female fastener means comprises a plurality of threaded inserts, each insert having plugging means for preventing debris from entering said inserts.

3. A fastening system for movable seating in accordance with claim 2 wherein:

said threaded inserts are arranged in an array of inserts defining a predetermined seating pattern, said array having alternative sub-arrays defining at least one alternative seating pattern.

4. A fastening system for movable seating in accordance with claim 3 wherein:

said threaded inserts are color coded such that different seating patterns are associated with particular colors of said threaded inserts.

5. A fastening system for movable seating in accordance with claim 3 wherein:

said plugging means is comprised of headed ferrous rivets, said rivets being removable from said inserts by a magnet, the number of said rivets being approximately equal to the number of inserts.

6. A fastening system for movable seating in accordance with claim 2 wherein:

said plugging means is comprised of single headed ferrous rivets, each having a head with a generally flat top surface and rounded edges, said rivets being removable from said inserts by a magnet, the number of said rivets being approximately equal to the number of said inserts.

7. A fastening system for movable seating comprising a seat base supporting at least one seat, said seat base having movable caster means for bringing a plurality of casters into and out of operating and storage positions, and locking means for holding said seat base and said set in a fixed position when said casters are not in said operating position, said female fastener means comprising a plurality of threaded inserts, said threaded inserts being arranged in an array of inserts defining a predetermined seating pattern, said array defining at least one alternative seating pattern, said threaded inserts being color coded such that different seating patterns are associated with particular colors of said threaded inserts.

8. A fastening system for movable seating in accordance with claim 7 wherein:

said system includes plugging means for preventing debris from entering said insert, and said plugging means is comprised of headed ferrous rivets, said rivets being removable from said inserts by a magnet.

* * * * *